US006173512B1

(12) United States Patent
Bitelli

(10) Patent No.: US 6,173,512 B1
(45) Date of Patent: Jan. 16, 2001

(54) SCARIFYING MACHINE WITH RE-ENTERING BACK WHEELS

(75) Inventor: Romolo Bitelli, S. Lazzaro (IT)

(73) Assignee: Bitelli SPA, Minerbio (BO) (IT)

( * ) Notice: Under 35 U.S.C. 154(b), the term of this patent shall be extended for 0 days.

(21) Appl. No.: 09/298,058

(22) Filed: Apr. 22, 1999

(30) Foreign Application Priority Data

Nov. 10, 1998 (IT) ..... VI9800098 U

(51) Int. Cl.[7] ..... E01C 23/12; E02F 5/00

(52) U.S. Cl. ..... 37/381; 404/90

(58) Field of Search ..... 37/381; 172/122; 404/84.05, 93, 87, 90, 91, 94; 299/39, 73, 75, 76, 78

(56) References Cited

U.S. PATENT DOCUMENTS 5,378,081 * 1/1995 Swisher, Jr. ..... 404/90

* cited by examiner

*Primary Examiner*—Robert E. Pezzuto
(74) *Attorney, Agent, or Firm*—Dykema Gossett PLLC

(57) ABSTRACT

A scarifying machine for soil removal having a frame supported by a couple of front wheels and a couple of back wheels, a milling drum is in contact with the soil to be removed and supported by a rotating shaft connected to the frame. A motor is supported by the frame and causes the milling drum and at least one of the wheels to rotate. Each back wheel is supported by an articulation unit that is mechanically connected to the frame and cooperates with a first hydraulic cylinder that is capable of shifting the articulation unit in order to arrange the wheel from a position projecting laterally from the frame to a position re-entering with respect to the frame and vise-versa.

20 Claims, 8 Drawing Sheets

SCARIFYING MACHINE WITH RE-ENTERING BACK WHEELS

BACKGROUND OF THE INVENTION

The invention concerns a scarifying machine provided with re-entering back wheels.

It is known that scarifying machines are manufacturing machines used for soil removal and particularly for the removal of the roadway carpet.

Fundamentally a scarifying machine includes a frame realized in strong metallic carpentry, provided with a milling drum placed into contact with the soil to be removed and supported by an horizontal rotation shaft connected to the frame.

The frame, in which there is a driving place where the operator sits, is supported by a couple of front driving wheels and by a couple of back wheels. The said back wheels are placed near the milling drum. Motorization means housed in an engine compartment included in the frame, impart a rotation to the milling drum and to the wheels for shifting the machine.

As regards the back wheels, each one of them is connected to a plate supported by an hydraulic cylinder with a vertical axis adjusting the depth of the ground penetration of the milling drum in order to change the milling depth. An articulation unit fixed to the frame and connected to the plate supporting the wheel, allows a projecting arrangement of the said wheel or a re-entering position with respect to the frame.

The possibility of placing the back wheels in a projecting position from the frame, allows the improvement of the weight distribution. On the contrary, the possibility of placing the back wheels also in a re-entering position with respect to the frame, allows the use of the scarifying machine to make excavations as far as reaching a wall. Moreover the shifts of the scarifying machine are made easier by the re-entered wheels when the machine is not operative.

SUMMARY OF THE INVENTION

According to the realizations of the known type the positioning of the back wheels in a re-entered arrangement or in a projecting one, is made manually by the operator. The operator works also on suitable manual hooking and release devices allowing the locking of each wheel in the re-entering position or in the projecting one in which it has been placed.

It can be understood that the manual character of the shift is awkward for the operator who is forced, in order to carry it out, to get out of the machine and to go on both sides of it to carry out the move of the wheel rotation.

The invention intends to overcome said limitation by realizing a scarifying machine for soil removal in which the shift operation of the back wheels from the projecting position to the re-entering position with respect to the frame is made in an automatized way.

Another aim is that after having been placed in the wanted position, each wheel can be locked automatically in the reached position.

A further aim is that the unlocking, shifting and following locking operations of each wheel are made automatically, in sequence and through the operation of a single drive member.

The said aims are reached through the realization of a scarifying machine for soil removal that, according to the main claim includes:

a frame including a driving place, supported by at least—a couple of front wheels and by at least a couple of back wheels;

a milling drum placed into contact with the soil to be removed and supported by a rotating shaft connected to said frame;

motorization means supported by said frame suitable to impart a rotation to said milling drum and to at least one of said wheels, and is characterized in that each one of said back wheels is supported by an articulation unit mechanically connected to said frame and cooperating with first actuator means suitable to shift said articulation unit in order to arrange said wheel from a position projecting laterally from said frame to a position re-entering with respect to the frame and vice versa.

According to a preferred embodiment the articulation unit includes also second actuator means making the articulation unit fixed with respect to the machine frame when the respective wheel is placed in a projecting position or in a reentering position with respect to the frame.

Advantageously, according to the invention the manual character of the shift of the back wheels is eliminated. The shift is therefore made faster and safer for the operator.

DESCRIPTION OF THE DRAWINGS

The said aims and advantages will be better underlined during the description of a preferred embodiment of the scarifying machine of the invention described referring to the enclosed drawings where.

DETAILED DESCRIPTION OF THE INVENTION

Figure 1:
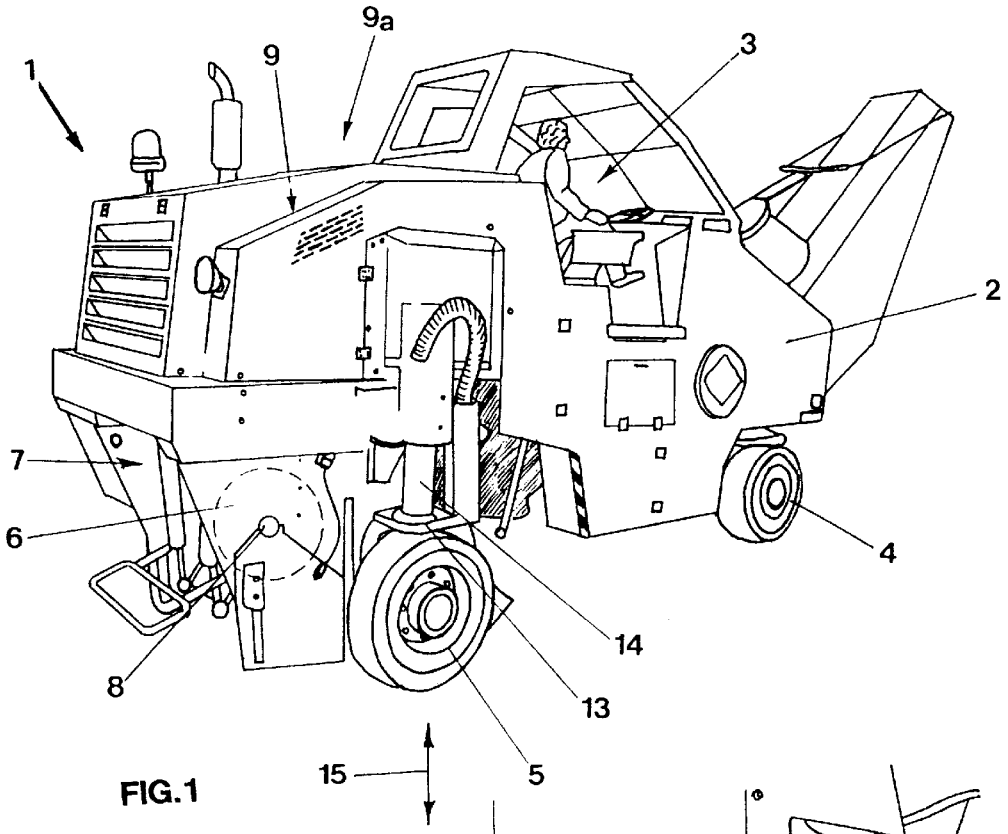
FIG. 1 shows the scarifier of the invention in an axonometric view.
Figure 2:
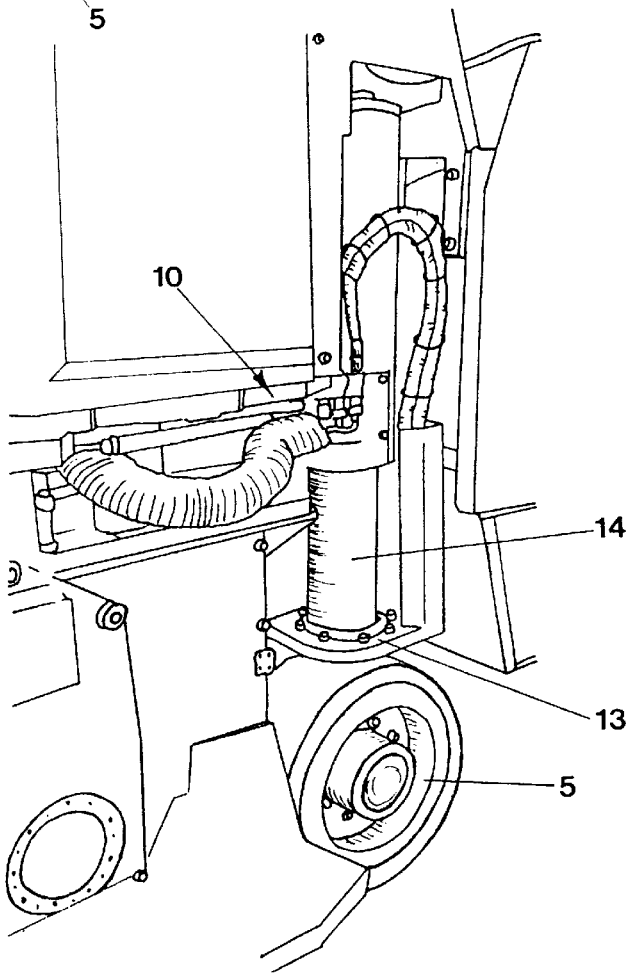
FIG. 2 shows a detail of the machine shown in FIG. 1.

As it can be observed in FIGS. 1 and 2 the scarifying machine of the invention, marked with 1 as a whole, includes a frame 2, in which there is a driving place 3, supported by a couple of front wheels and by a couple of back wheels of which, in FIG. 1, just one of said wheels is visible, respectively 4 and 5.

A milling frame 6, housed in a drum compartment marked with 7 as a whole, is placed into contact with the soil to be removed, since it is supported by a rotating shaft 8 placed horizontally and connected to the frame 2.

Motorization means 9 not visible in detail, supported by the frame 3 and placed inside the cowling 9*a* behind the driving place 3, are suitable to impart a rotation to the milling drum 6 and preferably but not necessarily also to all the front and back wheels, respectively 4 and 5.

Figure 3:
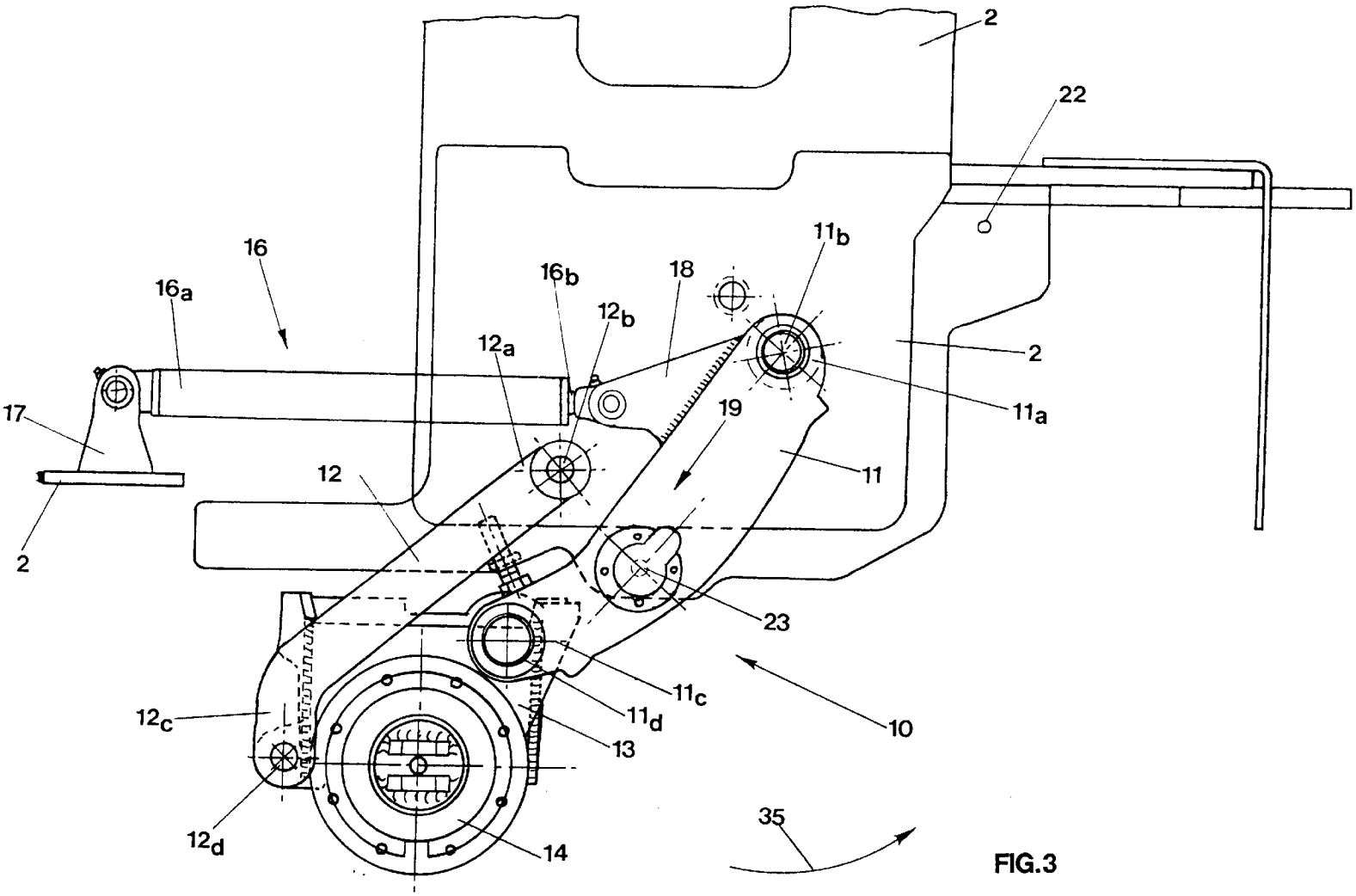
FIG. 3 shows a top view of a detail of the scarifying machine of the invention.

As regards in particular each back wheel 5 it can be observed referring to the FIG. 3, that it is supported by an articulation unit marked with 10 as a whole. Said articulation unit includes a couple of mechanical arms, respectively a first arm 11 and a second arm 12, put side by side. Each arm has an end 11*a*, 12*a* secured to the frame through a gudgeon 11*b*, 12*b* and the opposed end 11*c*, 12*c* secured, through a further gudgeon 11*d* and 12*d*, to a plate 13 connected to the wheel 5.

An hydraulic jack 14 connects the plate 13 to the frame 2 and allows the lifting and the lowering of the machine according to the directions of the arrow 15 in order to adjust the milling depth of the drum 6.

According to the invention each articulation unit 10 cooperates with first actuator means suitable to shift said articulation unit 10 in order to place the respective wheel 5 from a position laterally projecting from said frame 2 to a position re-entering with respect to the frame 2 and vice versa.

It can be observed in particular in FIG. 3 that said first actuator means consist in a first hydraulic cylinder marked with 16 as a whole, having a body 16*a* connected to a flange 17 fixed to a frame 2 and a movable stem 16*b* fixed to a bracket 18 belonging to a first arm 11.

Figure 5:
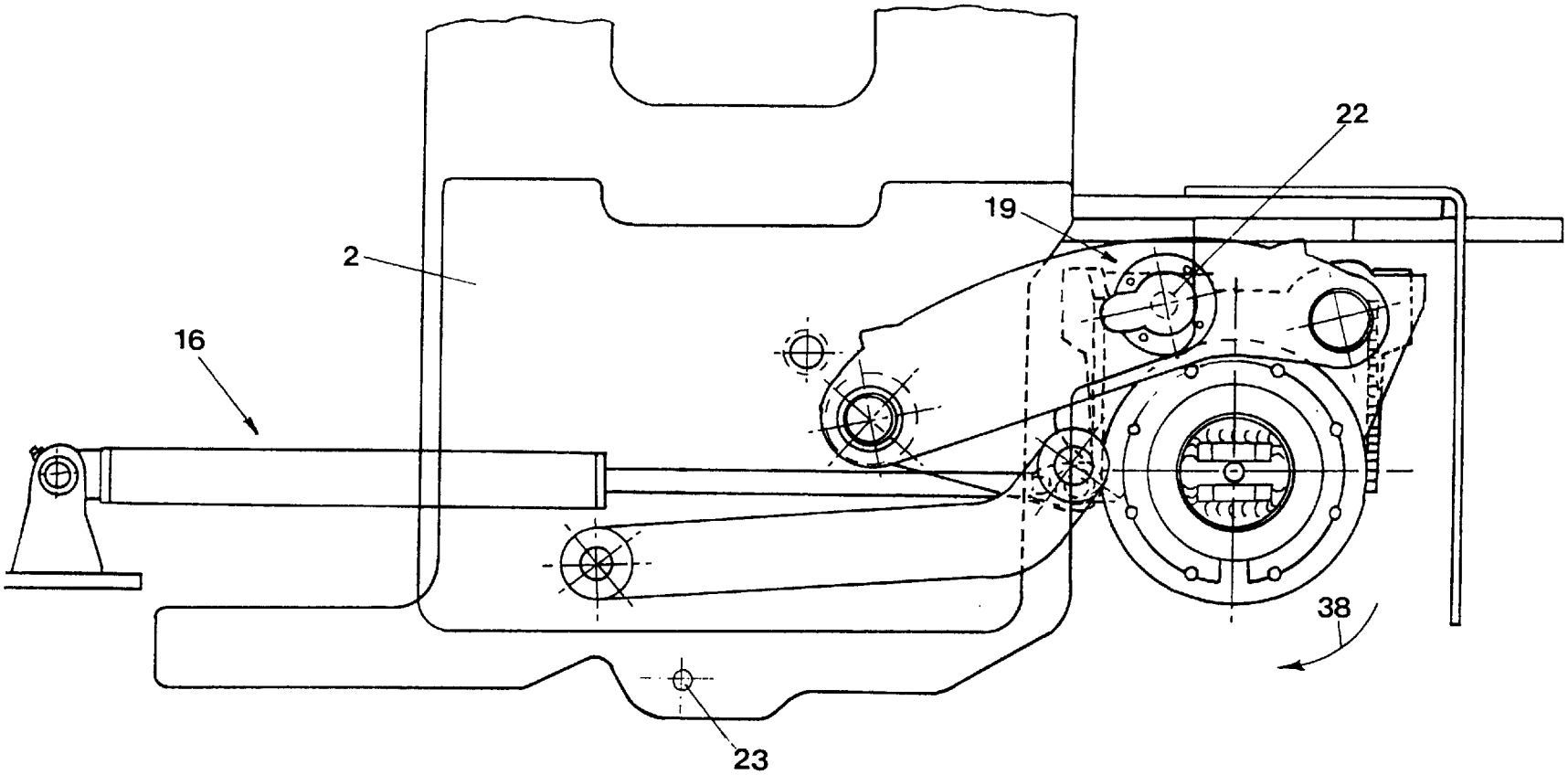
Figure 6:
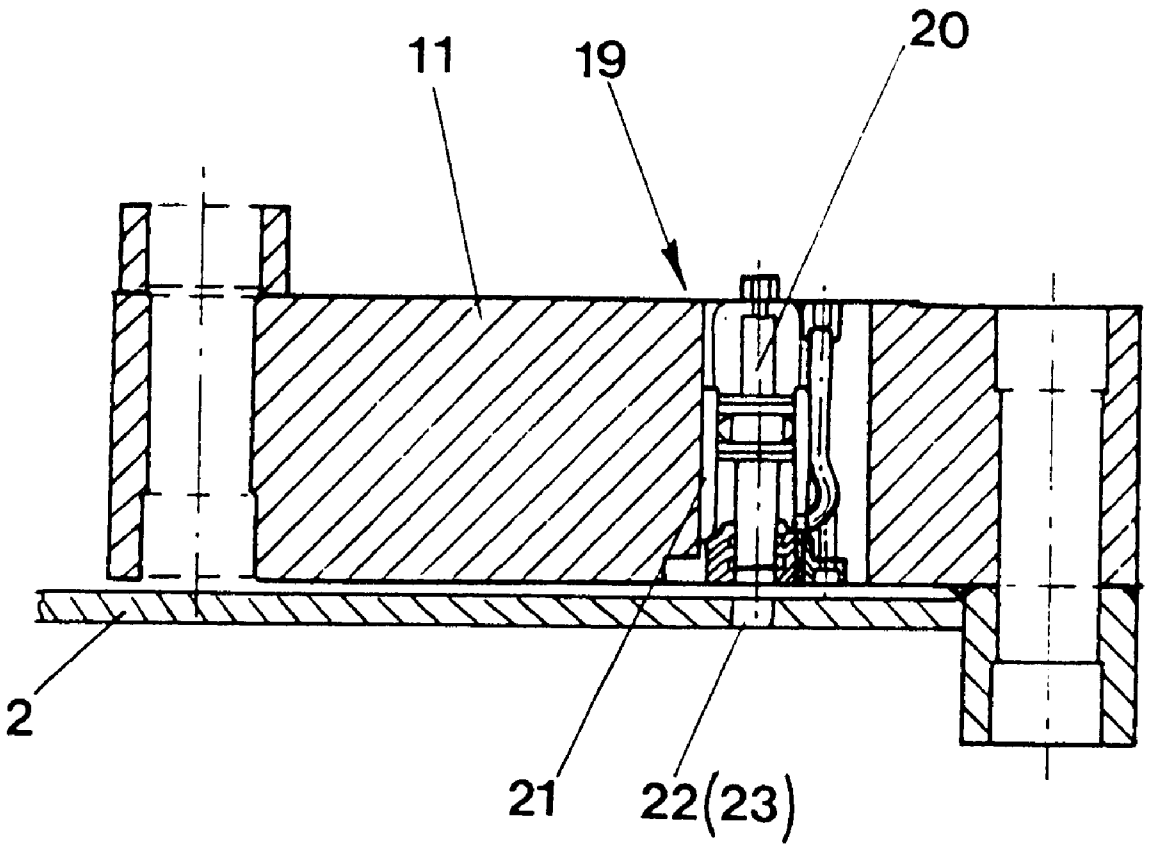
FIG. 6 shows the longitudinal section of another detail of the machine of the invention.

The first arm 11, as it can be observed in the detail of FIG. 6, houses second actuator means consisting in a second hydraulic cylinder 19. Said hydraulic cylinder 19 is formed substantially by a stem 20 which is coupled in a sliding way to the inside of a cylindrical seat 21 included in the body of the first arm 11. Said stem 20 is suitable to be housed in respective holes 22, 23 included in the frame and visible in the FIGS. 3, 4, 5 and particularly in FIG. 4.

Both the actuator means 16 and 19 are fed with oil under pressure brought through pipes not represented in the figure and in which the oil is put under pressure by pumping means, not represented in the figure as well, operated by motorization means 9 of the scarifying machine.

Figure 7:
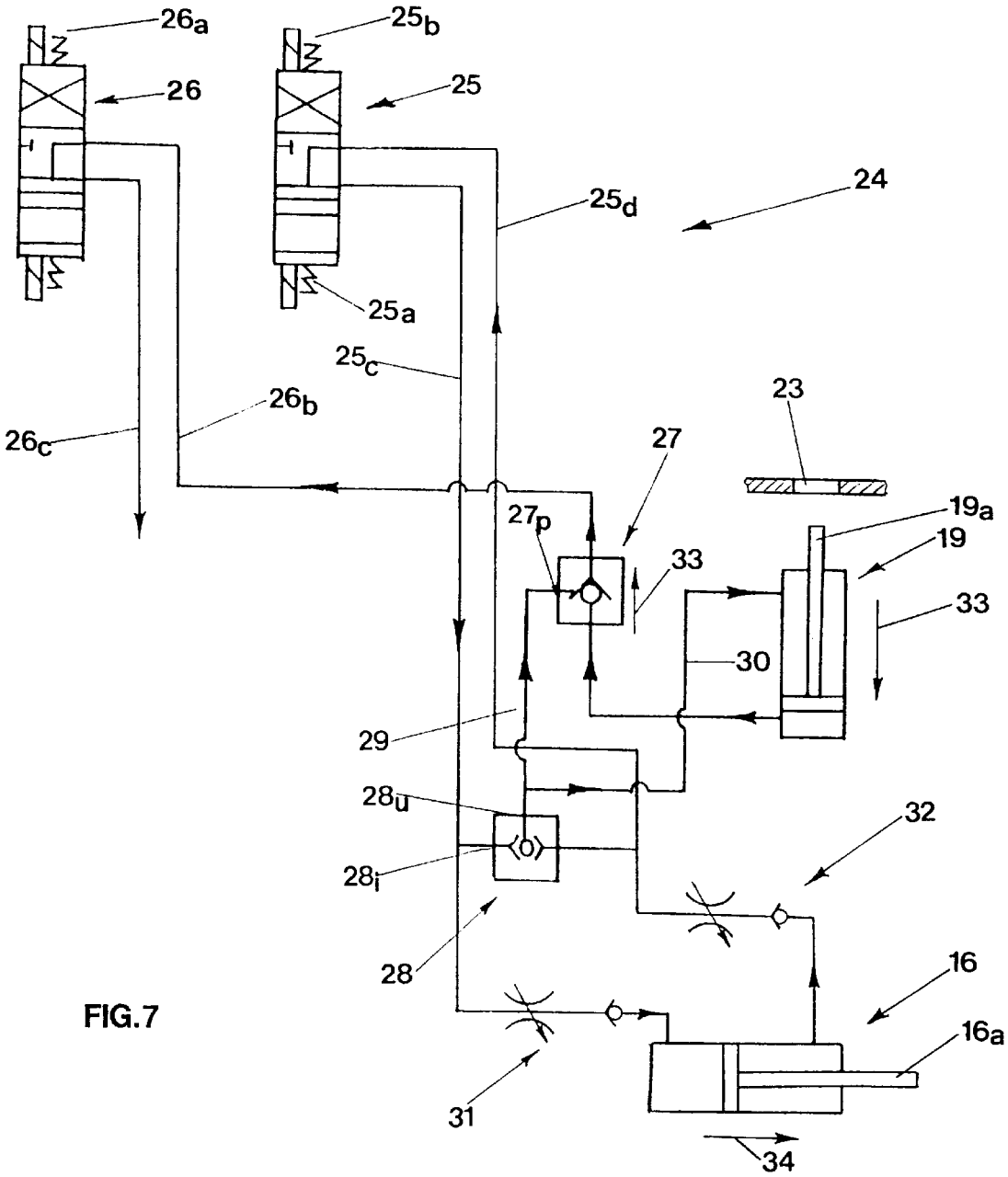
FIGS. 7, 8, 9 show the drive and shifting hydraulic circuit of the back wheels according to three different working configurations.
Figure 8:
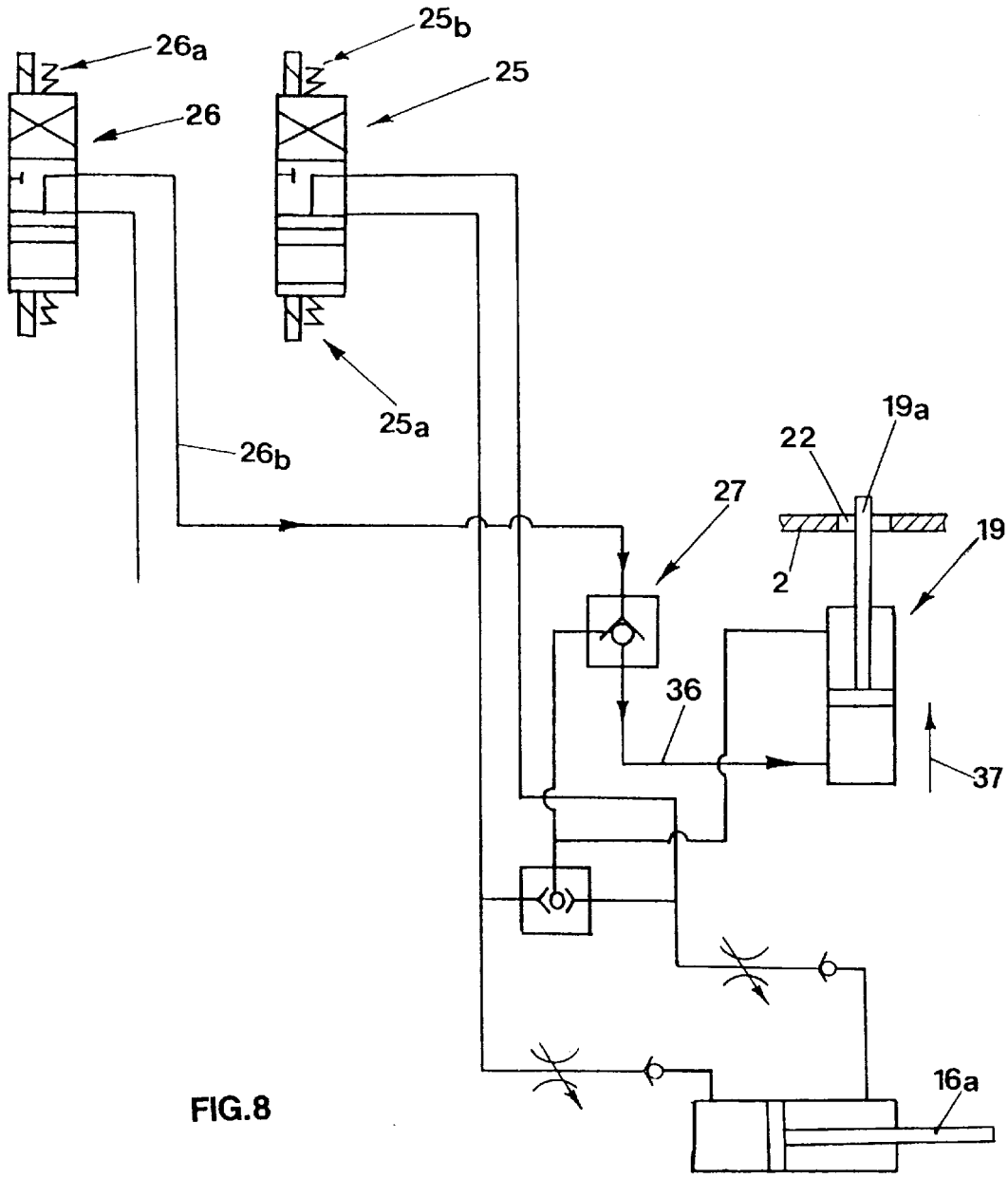
Figure 9:
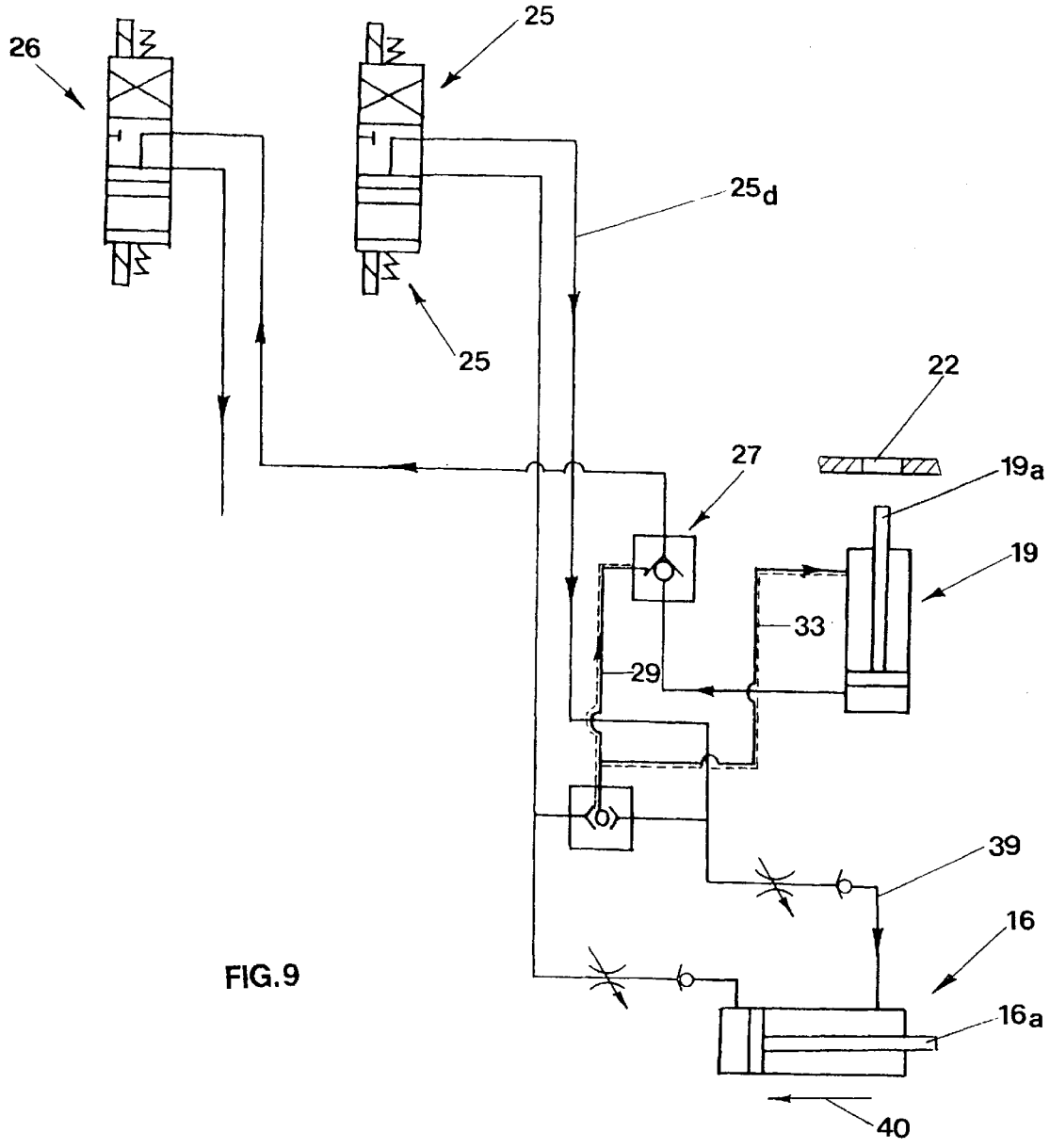

In particular the oil under pressure is distributed to the actuators 16 and 19 by a feeding circuit including means distributing the flow which are not visible in the FIGS. 7 to 9.

In particular it can be observed that the feeding circuit marked with 24 as a whole includes a first distributor 25 and a second distributor 26 feeding respectively the first hydraulic actuator 16 and the second hydraulic actuator 19. Said first hydraulic actuator 16 and the second hydraulic actuator 19 are, as it has been said, respectively the actuators powering the wheels shift and locking the wheels in the reached position.

A feeding circuit 24 includes also:

- a piloted nonreturn valve, marked with 27, put between the second distributor 26 and the second actuator 19;
- an OR valve, marked with 28, put between the first distributor 25 and the first actuator 16.

The outlet 28*u* of the valve OR 28 is connected through the pipe 29 to the inlet 27*p* of the pilotage of the nonreturn valve 27 and through a further pipe 30 to the second actuator 19.

Suitable flow governors with nonreturn valves marked with 31 and 32 as a whole are connected in correspondence with the chambers of the first actuator 16.

The shift of the back wheels 5 from the projecting position to the re-entering position and vice versa, is shown referring to the FIGS. 7 to 9 beginning from the starting position where the wheels are expected to be projecting laterally from the frame 2 of the machine.

The operator through a suitable move member excites the solenoid 25*a* of the first distributor 25 which, as it can be observed in FIG. 7, makes the oil under pressure flow through the pipe 25*c* according to the direction shown by the arrow. The fluid under pressure goes in the OR valve 28 through the inlet 28*i* and comes out through the outlet 28*u*. Then said fluid under pressure reaches, through the pipe 29, the inlet 27*p* of the pilotage of the nonreturn valve 27 and, through the pipe 30, the second hydraulic cylinder 19.

Because of the presence of the pressure signal at the inlet 27*p* of the pilotage of the valve 27, the latter can therefore be crossed according to the direction 33 opposed to its normal crossing direction. Therefore the oil under pressure, acting through the pipe 30 on the second hydraulic ram 19, shifts the stem 19*a*of the said second hydraulic ram 19 according to the direction 34 releasing it from the hole 23 made on the frame 2 and visible in FIG. 3.

The articulation unit 10 is therefore free to move with respect to the frame 2. When the oil under pressure flowing in the pipe 25*c* reaches the first hydraulic ram 16, it causes the release of the said first hydraulic ram 16 from the stem 16*a* according to the direction 34, forcing the articulation unit to rotate according to the counterclockwise direction shown by the arrow 35 in FIG. 3.

Figure 4:
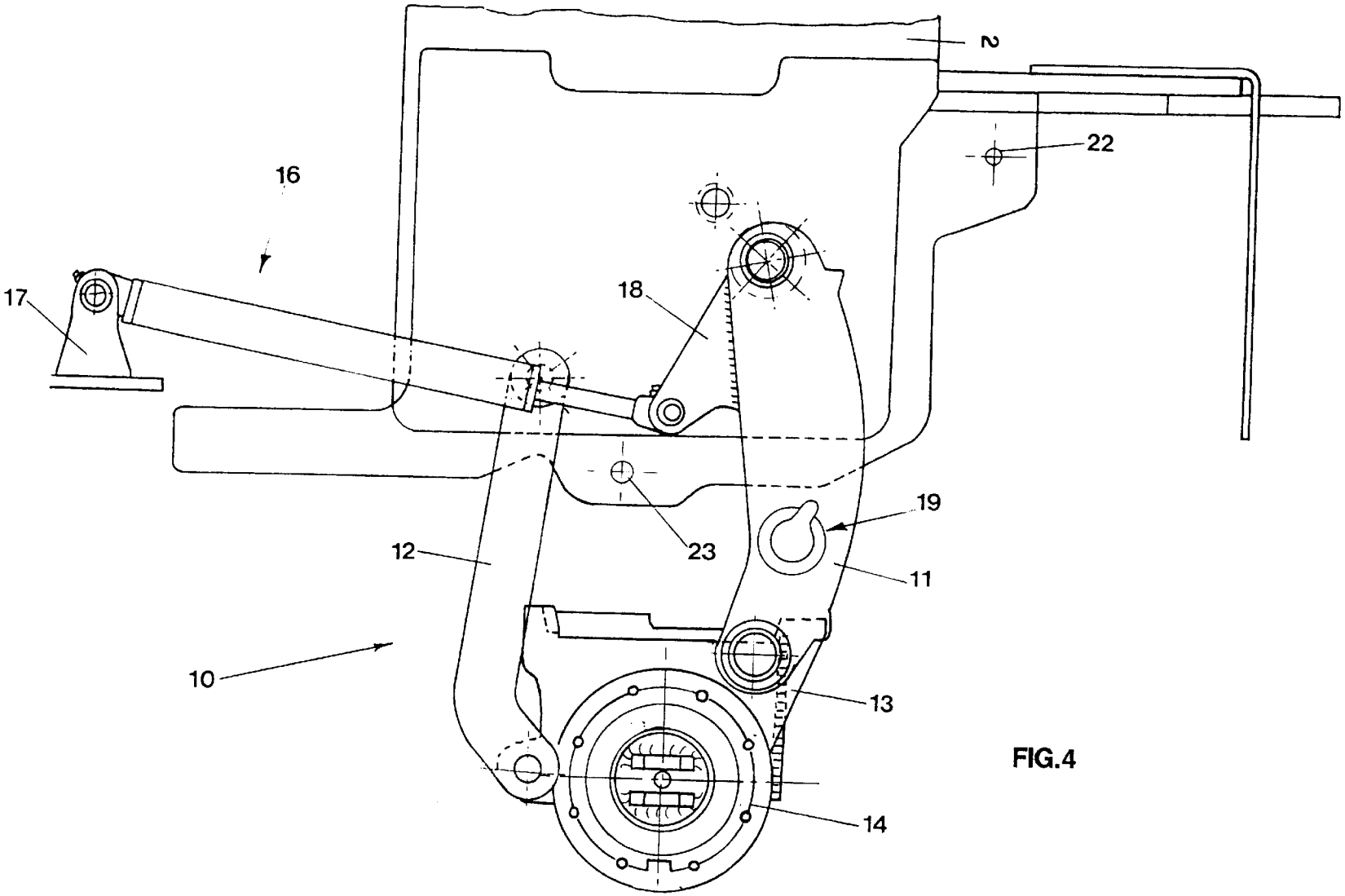
FIGS. 4 and 5 show the detail of FIG. 3 in two different positions.

The articulation unit 10, during the rotation, reaches the intermediate position shown in FIG. 4 before reaching the final position shown in FIG. 5, corresponding also to the position shown in FIG. 2, in which both the wheels 5 are locked.

In this condition, when each wheel is re-entered, the solenoid 26*a* of the second distributor 26 is automatically excited. The said second distributor 26, as it can be observed in FIG. 8, sends oil under pressure through the pipe 26*b* according to the direction shown by the arrow.

The oil under pressure crosses the piloted nonreturn valve 27 and through the pipe 36 feeds the second hydraulic ram 19 whose stem 19*a* is shifted according to the direction marked by the arrow 37, opposed to the previous one. The stem 19*a* goes into the hole 22 of the frame 2 granting the locking of the articulation unit 10 and of the wheel 5, integral with it, in the entering position.

In order to place again the wheel 5 in a projecting position, the second solenoid 25*b* of the first distributor 25 is excited. The said first distributor 25 sends the oil under pressure through the second solenoid 25*b* according to the direction shown by the arrow.

Similarly to what has been observed previously, through the pipe 29 a pressure signal comes to the piloted nonreturn valve 27 and at the same time the oil, through the pipe 30, comes also to the second actuator 19. The stem 19*a* of the second actuator 19 re-enters and by releasing the hole 22, unlocks again the articulation unit 10 from the frame 2. The articulation unit 10 is made to rotate according to the clockwise direction shown in FIG. 5 by the arrow 38 when the oil under pressure, through the pipe 39, acts in the first hydraulic ram 16 making the stem 16*a* re-enter according to the direction shown by the arrow 40.

When the articulation unit 10 and the wheel 5 integral with it are placed again in the projecting position that can be observed in FIG. 3, the stem 19*a* of the second hydraulic cylinder 19 goes again in the hole 23 of the frame 2 when the second distributor 26 is operated similarly to what has been said previously. It is important to underline that a suitable automatism, not described but being a part of the known technics, realizes, in a sequence and automatically, the operation of the second distributor 26 after the operator has operated the first distributor 25 and after the shift of both the articulation units 10 and of the wheel 5 joined to them.

In the executive phase it will be possible to realize the articulation unit, the feeding circuit of the actuators and other elements or units of the machine according to different structural technics than the ones which have been described and shown in the figures, resulting therefore in different embodiments of the invention.

It is intended that however said variants, since they are included in the scope of the following claims, are to be considered as protected by the present patent.

What is claimed is:

1. A scarifying machine for soil removal comprising:

a frame, supported by at least a pair of front wheels and by at least a pair of back wheels;

a milling drum adapted to be moved into contact with the soil to be removed and supported by a rotating shaft connected to said frame;

motorization means supported by said frame suitable to impart rotation to said milling drum and to at least one of said wheels, wherein each one of said back wheels is supported by an articulation unit rotatably connected to said frame, said articulation unit mechanically connected to and co-operating with first actuator means suitable to shift said articulation unit in order to arrange said wheel from a position projecting laterally from said frame to a position re-entering with respect to the frame and vice versa.

2. A scarifying machine according to claim 1, wherein said articulation unit includes second actuator means suitable to make said articulation unit fixed with respect to said frame when the respective wheel is placed in a projecting position and when said wheel is placed in a re-entering position with respect to said frame.

3. A scarifying machine according to claim 2, wherein said first and said second actuator means are fluid actuators which are fed with a fluid under pressure by pumping means connected to said motorization means and which is distributed by a feeding circuit including means for flow distribution suitable to feed said second actuators just before the start and just after the end of the shift of the respective articulation means caused by said first actuators.

4. A scarifying machine according to claim 3, wherein said fluid actuators are hydraulic cylinders.

5. A scarifying machine according to claim 3, wherein said first feeding circuit includes a first distributor feeding said first actuators and a second distributor feeding said second actuators, said distributors being of the type operated electrically through solenoids.

6. A scarifying machine according to claim 5, wherein said feeding circuit includes a piloted nonreturn valve located between said second distributor and said second actuators and an OR valve located between said first distributor and said first actuator.

7. A scarifying machine according to claim 5, wherein the outlet of said OR valve is connected to the inlet of the pilot signal of said piloted nonreturn valve.

8. A scarifying machine according to claim 1, wherein said articulation unit includes a pair of mechanical arms located side by side, each one having a proximal end rotatably connected to the frame of said machine and a distal end rotatably connected to a plate supporting an adjusting jack to which the back wheel is connected.

9. A scarifying machine according to claim 8, wherein at least one of said mechanical arms has a connecting flange to which the end of a movable rod of said first actuator means is fixed.

10. A scarifying machine according to claim 9, wherein the fixed body of said first actuator means is connected to said frame.

11. A scarifying machine according to claim 8, wherein at least one of said mechanical arms supports said second actuator means including a stem movable inside a seat formed in said arm, said stem being suitable to cooperate in holes formed in the frame of said scarifying machine.

12. A scarifying machine for soil removal comprising:

a frame and a rotatable shaft supported by the frame;

first and second pairs of wheels supporting the frame, at least one of said pairs being motorized;

a milling drum adapted to move into contact with the soil to be removed and supported by the rotatable shaft for rotation therewith;

motorization means supported by said frame and coupled to the shaft and to said pair of motorized wheels for imparting rotation thereto;

an articulation unit rotatably connected to the frame and supporting one of said pairs of wheels; and first actuator means mechanically coupled to the articulation unit for selectively shifting the wheels between an extended position externally of said frame and a retracted position internally of said frame.

13. A scarifying machine according to claim 12, wherein said articulation unit includes second actuator means for locking said articulation unit with respect to said frame when the wheels are in the extended and retracted positions respectively.

14. A scarifying machine according to claim 12, wherein said first and said second actuator means comprise fluid actuators fed with a pressurized fluid and pumping means connected to said motorization means for pressurizing the fluid.

15. A scarifying machine according to claim 14 further including a feeding circuit for feeding pressurized fluid to said first and second fluid actuators.

16. A scarifying machine according to claim 15, wherein said fluid actuators comprise hydraulic cylinders.

17. A scarifying machine according to claim 15, wherein said feeding circuit comprises a first distributor feeding said first actuators and a second distributor feeding said second actuators.

18. A scarifying machine according to claim 17, wherein said feeding circuit includes a piloted nonreturn valve located between said second distributor and said second fluid actuator and an OR valve located between said first distributor and said first fluid actuator.

19. A scarifying machine according to claim 18, wherein the OR valve has an outlet connected to an inlet of said piloted nonreturn valve.

20. A scarifying machine according to claim 12, wherein said articulation unit includes a pair of mechanical arms located side by side, each having a first end rotatably connected to the frame and a second end connected to the motorized wheels.

* * * * *